US007331424B2

(12) United States Patent
Hashiguchi

(10) Patent No.: US 7,331,424 B2
(45) **Date of Patent: *Feb. 19, 2008**

(54) ELEVATOR APPARATUS

(75) Inventor: Naoki Hashiguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/555,774

(22) PCT Filed: Jun. 7, 2004

(86) PCT No.: PCT/JP2004/008259

§ 371 (c)(1),
(2), (4) Date: Nov. 7, 2005

(87) PCT Pub. No.: WO2005/121007

PCT Pub. Date: Dec. 22, 2005

(65) Prior Publication Data

US 2006/0260878 A1 Nov. 23, 2006

(51) Int. Cl.
*B66B 9/00* (2006.01)

(52) U.S. Cl. ..... 187/249; 187/401; 187/406; 187/414; 187/259

(58) Field of Classification Search ..... 187/249, 187/401, 406, 250, 408, 404; *B66B 7/00, B66B 9/00, 7/06, 17/00, 7/02, 9/02*
See application file for complete search history.

(56) References Cited

U.S. PATENT DOCUMENTS 5,823,298 A 10/1998 Aulanko et al.
6,488,124 B1 12/2002 Yasuda et al.
2004/0007428 A1* 1/2004 Teramoto et al. ..... 187/249
2006/0231350 A1* 10/2006 Hashiguchi ..... 187/401
2007/0045053 A1* 3/2007 Hashiguchi ..... 187/408

FOREIGN PATENT DOCUMENTS

| | | | |
|---|---|---|---|
| EP | 1 319 627 | | 6/2003 |
| JP | 50-124063 | U | 10/1975 |
| JP | 1-069489 | | 3/1989 |
| JP | 01081782 | A * | 3/1989 |
| JP | 2-282177 | | 11/1990 |
| JP | 2-295876 | | 12/1990 |
| JP | 3-13484 | | 1/1991 |
| JP | 05-306083 | | 11/1993 |
| JP | 09-165163 | | 6/1997 |
| JP | 10-139327 | | 5/1998 |
| JP | 11-335039 | | 12/1999 |

* cited by examiner

*Primary Examiner*—Peter M. Cuomo
*Assistant Examiner*—Stefan Kruer
(74) *Attorney, Agent, or Firm*—Leydig, Voit & Mayer, Ltd.

(57) ABSTRACT

In an elevator apparatus, multiple cars are raised and lowered within a hoistway. The cars within the hoistway are adjacent to each other when located at the same height. If at least one of the cars is defined as a first car and a car adjacent to the first car is defined as a second car, the first car includes, in a face facing the second car a recess when projected onto a horizontal plane. At least a part of a car guide shoe is disposed in the recess.

8 Claims, 15 Drawing Sheets

ELEVATOR APPARATUS

TECHNICAL FIELD

The present invention relates to an elevator apparatus in which a plurality of elevator units are disposed in parallel within a hoistway.

BACKGROUND ART

For example, in a conventional elevator apparatus disclosed in JP 9-165163 A, a car guide rail is disposed in a space between a car and a wall of a hoistway. Further, a counterweight is disposed in a space behind the car guide rail within the hoistway. Moreover, a hoisting machine is disposed in a space in front of the car guide rail within the hoistway.

In the conventional elevator apparatus, however, a space for disposing the car guide rail between the car and the wall of the hoistway needs to be secured. This entails an increase in the space for the hoistway.

DISCLOSURE OF THE INVENTION

The present invention is made to solve the problem as mentioned above, and has an object of providing an elevator apparatus enabling a further reduction in the space for a hoistway.

To this end, according to one aspect of the present invention, there is provided an elevator apparatus comprising: a plurality of cars provided within a hoistway so that the plurality of cars are adjacent to one another when located at an equal height, the plurality of cars each being raised and lowered within the hoistway; a plurality of car guide rails disposed within the hoistway, for guiding the cars when the cars are raised and lowered; and a plurality of car guide shoes mounted on the respective cars, for engaging the car guide rails, wherein: when at least one of the cars is defined as a first car and a car adjacent to the first car is defined as a second car, the first car has, on a vertical projection plane, a recess provided in its side face facing the second car; and at least a part of the car guide shoe is disposed in the recess.

BEST MODES FOR CARRYING OUT THE INVENTION

Preferred embodiments of the present invention will be described hereinafter with reference to the drawings.

Embodiment 1

Figure 1:
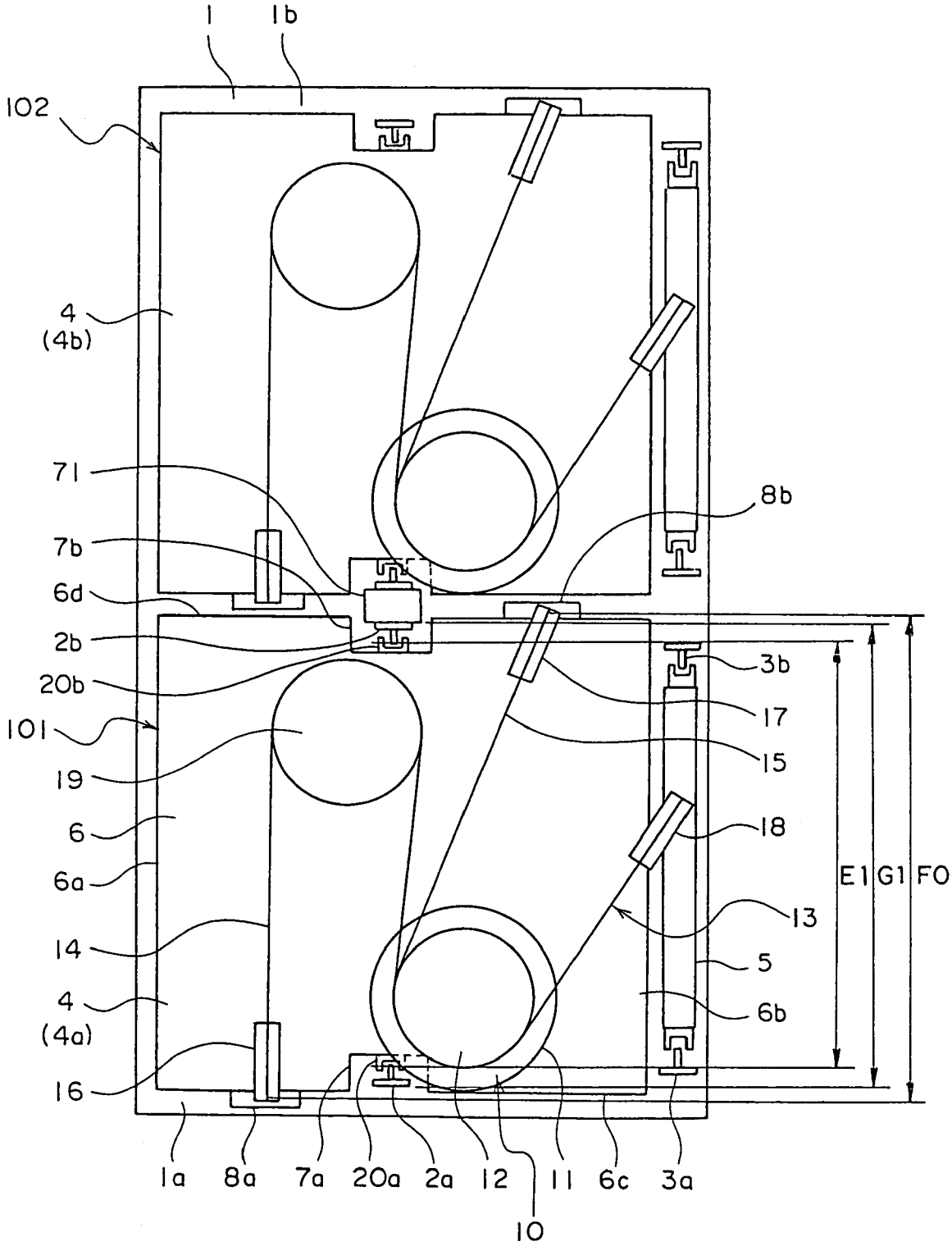
FIG. 1 is a plan view showing an elevator apparatus according to Embodiment 1 of the present invention.
Figure 2:
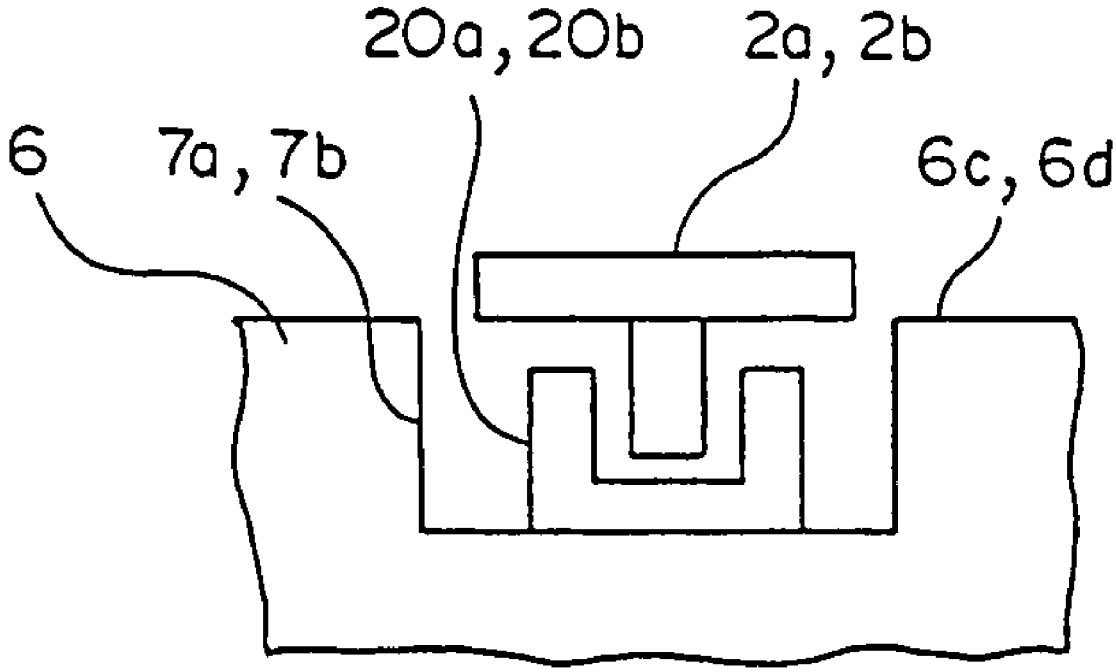
FIG. 2 is a plan view showing an essential part of FIG. 1 in an enlarged manner.
Figure 3:
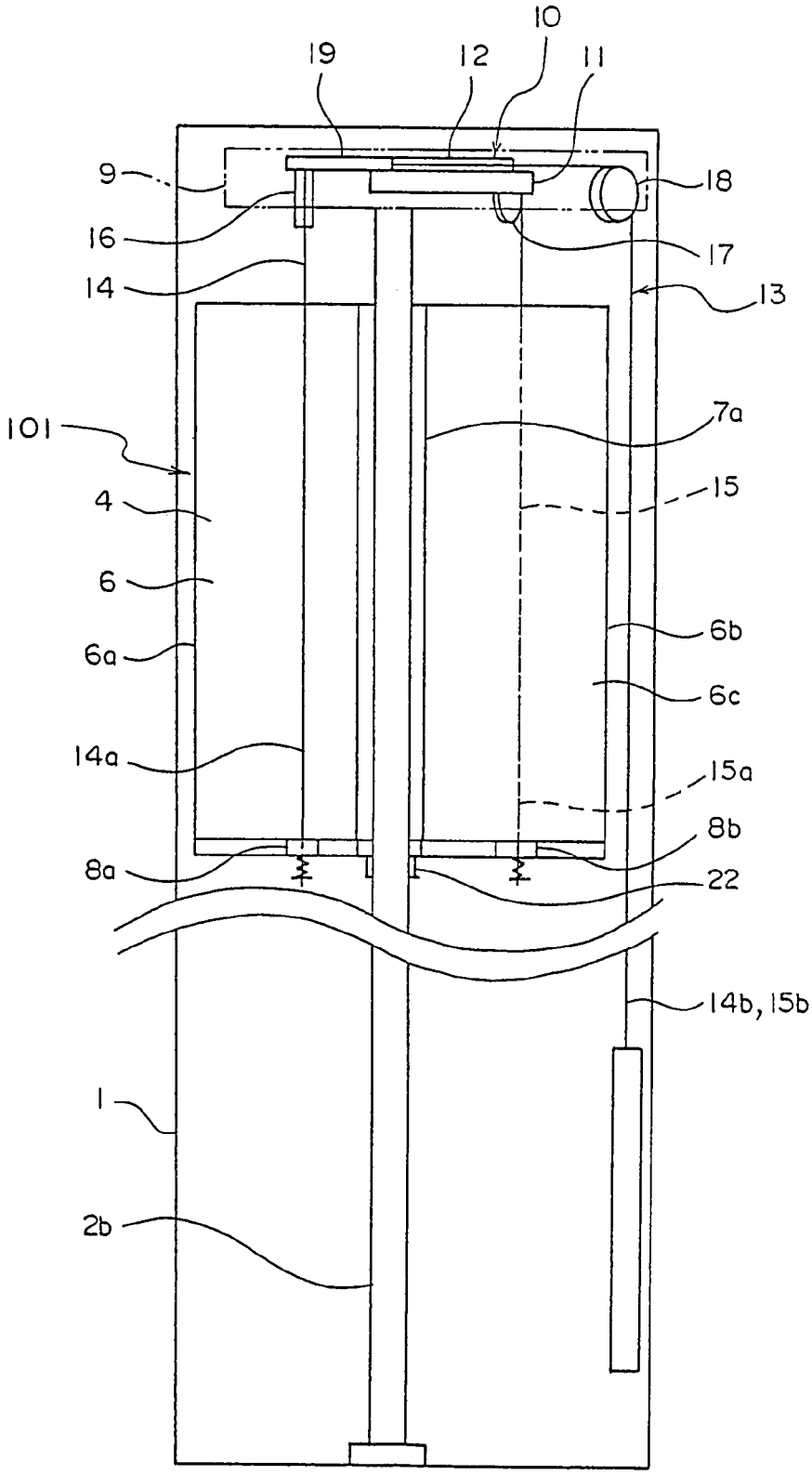
FIG. 3 is a side view showing the elevator apparatus of FIG. 1.

FIG. 1 is a plan view showing an elevator apparatus (a machine-room-less elevator) according to Embodiment 1 of the present invention. FIG. 2 is a plan view showing an essential part of FIG. 1 in an enlarged manner. FIG. 3 is a side view showing the elevator apparatus of FIG. 1.

Referring to the figures, first and second elevator units 101 and 102 are installed within a hoistway 1. In other words, a hoistway 1*a* of the first elevator unit 101 and a hoistway 1*b* of the second elevator unit 102 are connected to each other, thus forming the hoistway 1.

Since the first and second elevator units 101 and 102 are basically identical in construction, the construction of the first elevator unit 101 will be mainly described.

First and second car guide rails 2*a* and 2*b* and first and second counterweight guide rails 3*a* and 3*b* are disposed within the hoistway 1. Each of the guide rails 2*a*, 2*b*, 3*a*, and 3*b* has a T-shaped cross-section.

A car 4 is raised and lowered within the hoistway 1 while being guided by the car guide rails 2*a* and 2*b*. A counterweight 5 is raised and lowered within the hoistway 1 while being guided by the counterweight guide rails 3*a* and 3*b*.

The car 4 has a car frame (not shown) and a cage 6 supported by the car frame. The cage 6 has a floor portion, a wall portion, and a ceiling portion. The wall portion of the cage 6 has a front face 6*a* provided with a car entrance (not shown), a rear face 6*b* facing the front face, a first side face 6*c*, and a second side face 6*d* facing the first side face.

On a vertical projection plane (a horizontal cross-section of the hoistway), the first side face 6*c* is provided with a first recess 7*a*, and the second side face 6*d* is provided with a second recess 7*b*. The first and second recesses 7*a* and 7*b* are continuously provided along a direction in which the car 4 is raised and lowered (vertical direction). In other words, the first and second recesses 7*a* and 7*b* are formed like grooves.

By providing the first and second recesses 7*a* and 7*b*, a few slight projections are formed in the cage 6. However, these projections are not large enough to affect the passenger capacity of the elevator apparatus.

A first car guide shoe 20*a* engaging the first car guide rail 2*a* is at least partially disposed in the first recess 7*a*. A second car guide shoe 20*b* engaging the second car guide rail 2*b* is at least partially disposed in the second recess 7*b*. In this example, the car guide shoes 20*a* and 20*b* are entirely accommodated in the recesses 7*a* and 7*b* respectively.

Thus, the dimension between the car guide shoes 20*a* and 20*b* is smaller than the dimension between the first and second side faces 6*c* and 6*d*, except the dimension between the recesses 7*a* and 7*b*.

The car guide shoes 20*a* and 20*b* are not particularly limited in type. For instance, sliding guide shoes, roller guide shoes, magnetic guide shoes, or the like can be used. It is desirable that 80% or more of the car guide shoes 20*a* and 20*b* be accommodated within the recesses 7*a* and 7*b* as seen in their cross-sections, respectively.

Further, on the vertical projection plane, the car guide rails 2*a* and 2*b* are at least partially disposed within the recesses 7*a* and 7*b* respectively. The car guide rails 2*a* and 2*b* are disposed facing the recesses 7*a* and 7*b* respectively.

The first and second recesses 7*a* and 7*b* are provided at the same position in the depth direction of the cage 6. The car guide rails 2*a* and 2*b* face each other. In other words, on the vertical projection plane, centerlines of the car guide rails 2*a* and 2*b* are parallel to each other and located on the same straight line.

When the counterweight 5 is located at the same height as the car 4, it is disposed behind the car 4 so as to face the rear face 6*b*.

First and second rope connecting portions 8*a* and 8*b* are provided in a lower portion of the car 4. The first and second rope connecting portions 8*a* and 8*b* slightly project from the first and second side faces 6*c* and 6*d* respectively on the vertical projection plane. Further, on the vertical projection plane, the first and second rope connecting portions 8*a* and 8*b* are disposed symmetrically or substantially symmetrically with respect to the center of gravity of the car 4.

In addition, the first rope connecting portion 8*a* is disposed in front of the first car guide rail 2*a* in the depth direction of the car 4. The second rope connecting portion 8*b* is disposed behind the second car guide rail 2*b* in the depth direction of the car 4.

A support frame 9 (FIG. 3) is installed in an upper portion of the hoistway 1. The support frame 9 is at least partially supported by the car guide rails 2*a* and 2*b* and the counterweight guide rails 3*a* and 3*b*. Alternatively, the support frame 9 may be supported by a support portion provided to a building.

The support frame 9 supports a drive device (hoisting machine) 10 that generates a driving force for raising and lowering the car 4 and the counterweight 5. The drive device 10 has a drive device main body 11 including a motor and a brake, and a drive sheave 12 rotated by the drive device main body 11.

In this example, the drive sheave 12 is disposed on the drive device main body 11. Further, the drive sheave 12 is directly driven by the motor of the drive device main body 11 without the intervention of a decelerating mechanism.

Further, the drive device 10 is disposed horizontally (or substantially horizontally) such that a rotating shaft of the drive sheave 12 extends vertically (or substantially vertically). Employed as the drive device 10 is a thin hoisting machine having an axial dimension that is smaller than an outer diameter dimension in a direction perpendicular to the axial direction.

Moreover, the drive device 10 is entirely or substantially entirely superimposed on the car 4 on the vertical projection plane. In other words, the drive device 10 is disposed directly above the car 4.

A main rope group 13 for suspending the car 4 and the counterweight 5 within the hoistway 1 is wound around the drive sheave 12. The main rope group 13 includes a plurality of first main ropes 14 (only one of which is shown in the figure) and a plurality of second main ropes 15 (only one of which is shown in the figure).

The car 4 and the counterweight 5 are suspended according to a 1:1 roping method by means of the main rope group 13.

Each first main rope 14 has a first end portion 14*a* connected to the first rope connecting portion 8*a*, and a second end portion 14*b* connected to an upper portion of the counterweight 5. Each second main rope 15 has a third end portion 15*a* connected to the second rope connecting portion 8*b*, and a fourth end portion 15*b* connected to the upper portion of the counterweight 5.

A first pulley 16 for guiding the first main rope 14 to the first rope connecting portion 8*a*, a second pulley 17 for guiding the second main rope 15 to the second rope connecting portion 8*b*, a third pulley 18 for guiding the first and second main ropes 14 and 15 to the counterweight 5, and a deflection pulley 19 for guiding the first main rope 14 extending from the drive sheave 12 to the first pulley 16 are mounted on the support frame 9.

The first pulley 16 is disposed directly above the first rope connecting portion 8*a*. The second pulley 17 is disposed directly above the second rope connecting portion 8*b*.

The first to third pulleys 16 to 18 are disposed such that their rotating shafts extend horizontally. The deflection pulley 19 is disposed such that its rotating shaft extends vertically (or substantially vertically).

The drive device 10 and the pulleys 16 to 19 are mounted on the common support frame 9 and unitized. Further, it is also appropriate to construct the drive devices 10 and the pulleys 16 to 19 of the first and second elevator units 101 and 102 as a single unit, using the support frame 9 common to the first and second elevator units 101 and 102.

If it is assumed that F0 denotes an inter-car suspension pitch (a dimension between the first end portion 14*a* and the third end portion 15*a* in the width direction of the car 4), that G1 denotes an inter-car guide rail rear face pitch (a dimension between the rear faces of the car guide rails 2*a* and 2*b* in the width direction of the car 4), and that El denotes an inter-guide shoe pitch (a dimension between the car guide shoes 20*a* and 20*b* in the width direction of the car 4), it follows that F0≧G>E1.

A safety device 22 (FIG. 3) for bringing the car 4 to an emergency stop when the elevator undergoes an abnormality such as an overspeed is mounted on a lower portion of the car 4. The safety device 22 may be a mechanical device operating through the transmission of a mechanical operating force or an electric device having an actuator that operates in response to an electric actuation signal.

On the vertical projection plane, the safety device 22 is at least partially disposed in the recesses 7*a* and 7*b*. In this example, the safety device 22 has an engaging portion for engaging the car guide rails 2*a* and 2*b*, and this engaging portion is entirely accommodated in the recesses 7*a* and 7*b*.

The first and second elevator units 101 and 102 are each constructed as described above.

Given that the car 4 of the first elevator unit 101 is a first car 4*a* and that the car 4 of the second elevator unit 102 is a second car 4*b*, the first and second cars 4*a* and 4*b* are so provided within the hoistway 1 as to be adjacent to each other when they are located at the same height. In other words, the first and second cars 4*a* and 4*b* are provided side by side so as not to overlap with each other on a plane cross section of the hoistway 1.

On the vertical projection plane, the second recess 7*b* of the first car 4*a* is provided in the side face 6*d* of the first car 4*a* which faces the second car 4*b*, and the first recess 7*a* of the second car 4*b* is provided in the side face 6*c* of the second car 4*b* which faces the first car 4*a*.

Further, on the vertical projection plane, the second recess 7*b* of the first car 4*a* and the first recess 7*a* of the second car 4*b* face each other. In other words, the second recess 7*b* of the first car 4*a* and the first recess 7*a* of the second car 4*b* are disposed at the same position in the depth direction of the first and second cars 4*a* and 4*b*.

A rear face of the first car guide rail 2*a* of the second elevator unit 102 faces a rear face of the second car guide rail 2*b* of the first elevator unit 101. On the vertical projection plane, a guide rail support pillar 71 is erected in a space surrounded by the second recess 7*b* of the first car 4*a* and the first recess 7*a* of the second car 4*b*.

The second car guide rail 2*b* of the first elevator unit 101 and the first car guide rail 2*a* of the second elevator unit 102 are mounted to the guide rail support pillar 71. The guide rail support pillar 71 is rigid enough to support the car guide rails 2*a* and 2*b*.

The other guide rails 2*a*, 2*b*, 3*a*, and 3*b* are fixed to the wall of the hoistway through rail brackets (not shown).

A clearance between the second rope connecting portion 8*b* of the first car 4*a* and the first side face 6*c* of the second car 4*b*, and a clearance between the first rope connecting portion 8*a* of the second car 4*b* and the second side face 6*d* of the first car 4*a* are minimized so that no interference occurs when the first and second cars 4*a* and 4*b* pass each other.

Further, the clearance between the second rope connecting portion 8*b* of the first car 4*a* and the first side face 6*c* of the second car 4*b*, and the clearance between the first rope connecting portion 8*a* of the second car 4*b* and the second side face 6*d* of the first car 4*a* are smaller than the dimensions of the car guide rails 2*a* and 2*b* in the width direction of the car 4.

In the elevator apparatus constructed as described above, since the car guide shoes 20*a* and 20*b* and the car guide rails 2*a* and 2*b* are disposed in the recesses 7*a* and 7*b* provided in the cage 6, the installation space for the elevator apparatus in the width direction of the car 4 can be reduced. As a result, the space for the hoistway can further be reduced.

In particular, in an elevator apparatus having such a construction that the first and second elevator units 101 and 102 are disposed in parallel within the hoistway 1, the clearance between the first and second elevator units 101 and 102 can be set to a minimum required value, so that the space for the hoistway can be effectively reduced.

Further, since the recesses 7*a* and 7*b* of the first and second cars 4*a* and 4*b* that are adjacent to each other are disposed at the same position in the depth direction of the car 4, the common guide rail support pillar 71 can support the car guide rails 2*a* and 2*b* located between the first and second cars 4*a* and 4*b*. This makes it possible to achieve structural simplification and a further reduction in the installation space for the elevator apparatus.

Furthermore, since $F0 \geqq G1$, the space for the hoistway can be more effectively reduced. By the same token, since $F0 > E1$, the space for the hoistway can be more effectively reduced.

In particular, if a decrease in the cross-sectional area of the hoistway 1 resulting from the provision of the recesses 7*a* and 7*b* is larger than a decrease in the cross-sectional area of the cage 6 resulting from the provision of the recesses 7*a* and 7*b*, the space for the hoistway can be more effectively reduced.

Further, since the safety device 22 is at least partially disposed in the recesses 7*a* and 7*b*, the safety device 22 can be prevented from protruding from the car 4, so that the installation space for the elevator apparatus in the width direction of the car 4 can be reduced. As a result, the space for the hoistway can further be reduced.

In Embodiment 1, the car guide rails 2*a* and 2*b* are disposed at the same position in the depth direction of the car 4. However, the car guide rails may be disposed offset from each other in the depth direction of the car 4.

Further, in Embodiment 1, both the first and second cars 4*a* and 4*b* are provided with the recesses 7*a* and 7*b* respectively. However, only one of the first and second cars may be provided with a recess. In this case, for example, only the first car may be provided with a recess, and that the car guide shoe of the first car, the car guide rail of the first car, and the car guide rail of the second car may be at least partially disposed in the recess. In addition, it is also possible to dispose the car guide shoe of the second car at least partially in the recess of the first car.

Embodiment 2

Figure 4:
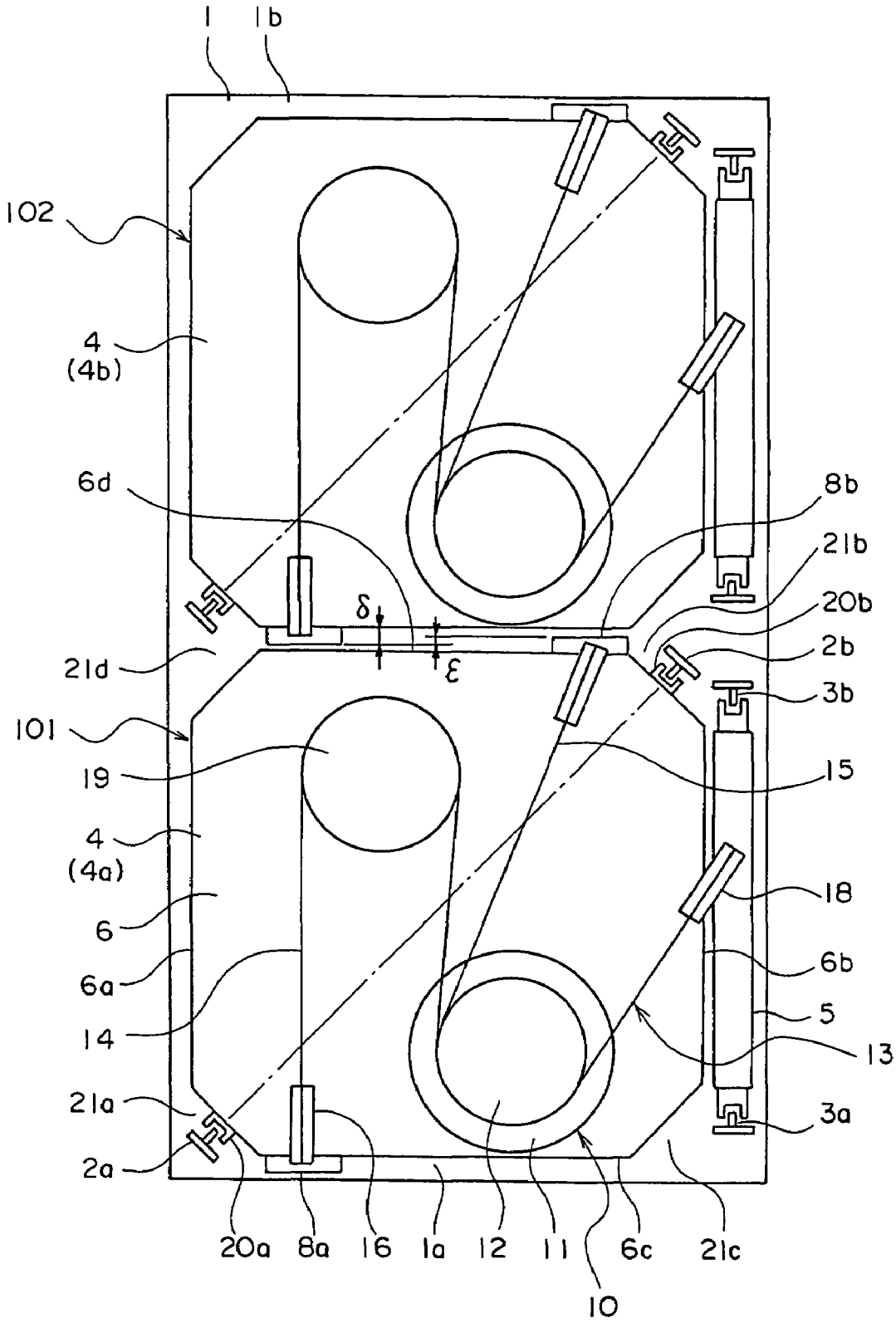
FIG. 4 is a plan view showing an elevator apparatus according to Embodiment 2 of the present invention.
Figure 5:
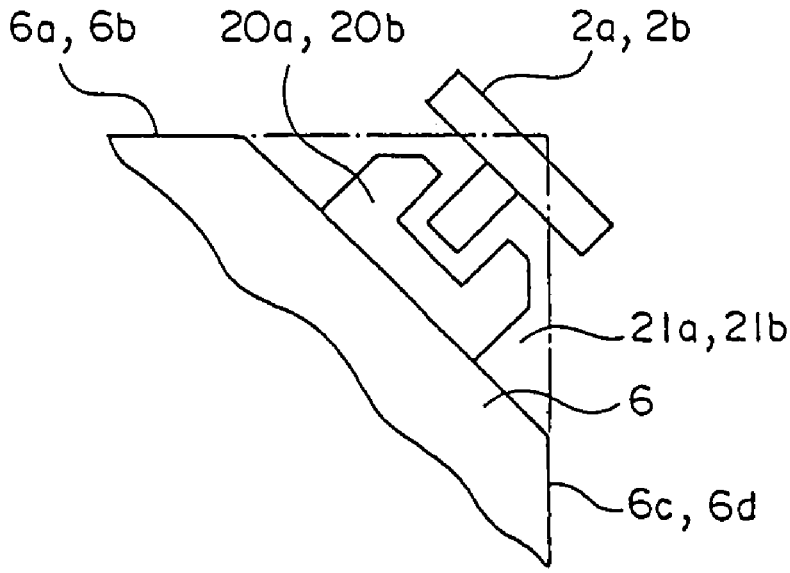
FIG. 5 is a plan view showing an essential part of FIG. 4 in an enlarged manner.
Figure 6:
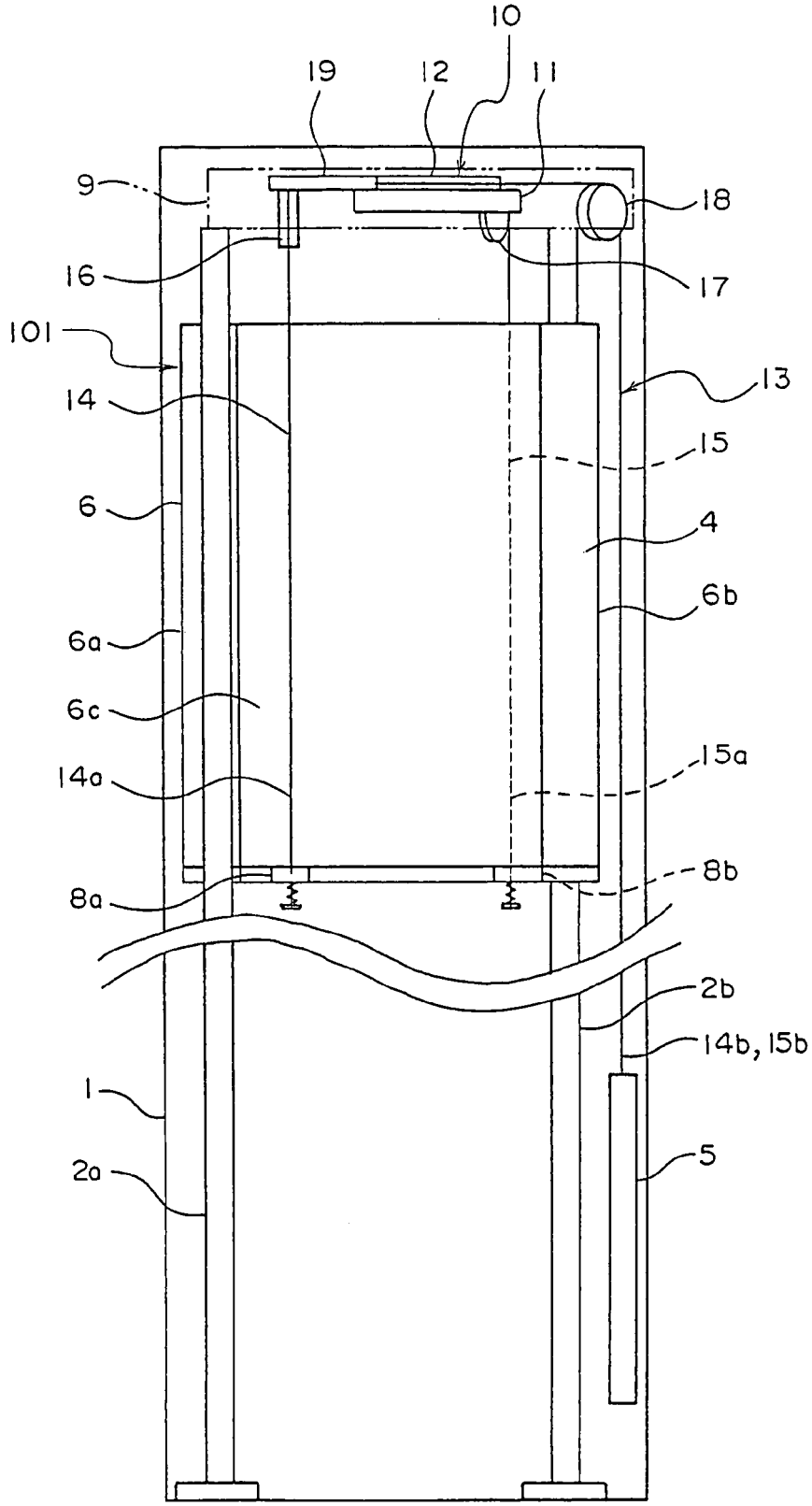
FIG. 6 is a side view showing the elevator apparatus of FIG. 4.

Next, FIG. 4 is a plan view showing an elevator apparatus (machine-room-less elevator) according to Embodiment 2 of the present invention. FIG. 5 is a plan view showing an essential part of FIG. 4 in an enlarged manner. FIG. 6 is a side view showing the elevator apparatus of FIG. 4.

Referring to the figures, a first recess 21*a* is provided in a corner portion between the front face 6*a* and the first side face 6*c* of the cage 6. A second recess 21*b* is provided in a corner portion between the rear face 6*b* and the second side face 6*d* of the cage 6. A third recess 21*c* is provided in a corner portion between the rear face 6*b* and the first side face 6*c* of the cage 6. A fourth recess 21*d* is provided in a corner portion between the front face 6*a* and the second side face 6*d* of the cage 6.

The recesses 21*a* to 21*d* are so formed as to chamfer the four corners of the rectangular cage 6 on the vertical projection plane. In other words, the recesses 21*a* to 21*d* can also be referred to as chamfered portions, notched corner portions, or notched cross-section portions. A bottom face (chamfered face) of the first recess 21*a* and a bottom face of the second recess 21*b* are parallel or substantially parallel to each other. A bottom face of the third recess 21*c* and a bottom face of the fourth recess 21*d* are parallel or substantially parallel to each other.

The recesses 21*a* to 21*d* are continuously provided along the direction in which the car 4 is raised and lowered (vertical direction).

The first car guide shoe 20*a* engaging the first car guide rail 2*a* is at least partially disposed in the first recess 21*a*. The second car guide shoe 20*b* engaging the second car guide rail 2*b* is at least partially disposed in the second recess 21*b*. In this example, the car guide shoes 20*a* and 20*b* are entirely accommodated in the recesses 21*a* and 21*b* respectively.

In other words, as shown in FIG. 5, the first car guide shoe 20*a* is disposed substantially inside a triangular area (within the first recess 21*a*) that is surrounded by an extended straight line of the front face 6*a*, an extended straight line of the first side face 6*c*, and the bottom face of the first recess 21*a*, on the vertical projection plane. Further, the second car guide shoe 20*b* is substantially disposed inside a triangular area (within the second recess 21*b*) that is surrounded by an extended straight line of the rear face 6*b*, an extended straight line of the second side face 6*d*, and the bottom face of the second recess 21*b*, on the vertical projection plane.

It is desirable that the car guide shoes 20*a* and 20*b* be so disposed as to be accommodated in the recesses 21*a* and 21*b* respectively by 80% or more as seen in their cross-sections.

Further, on the vertical projection plane, the car guide rails 2*a* and 2*b* are at least partially disposed in the recesses 21*a* and 21*b* respectively. The car guide rails 2*a* and 2*b*, which face each other, face the bottom faces of the first and second recesses 21*a* and 21*b* respectively. In other words, on the vertical projection plane, the centerlines of the car guide rails 2*a* and 2*b* are parallel to each other and located on the same straight line (a diagonal line of the cage 6).

Figure 7:
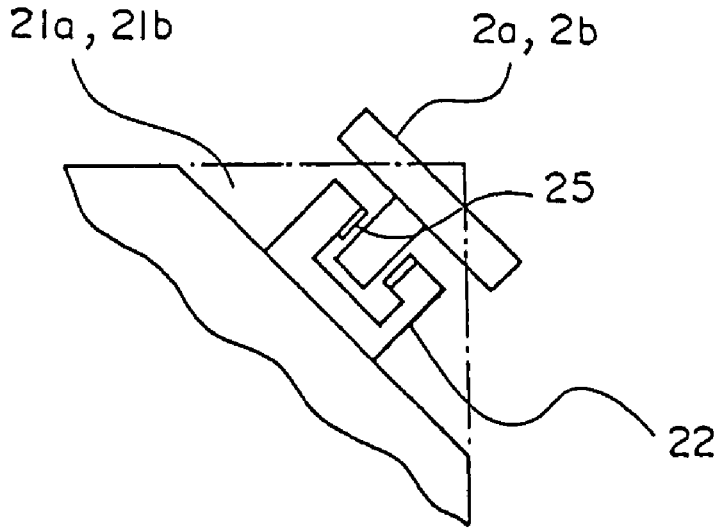
FIG. 7 is a plan view showing a safety device of the elevator apparatus of FIG. 4.

As shown in FIG. 7, on the vertical projection plane, the safety device 22 is at least partially disposed in the recesses 21*a* and 21*b*. In this example, the safety device 22 has an engaging portion for engaging the car guide rails 2*a* and 2*b*, and this engaging portion is entirely accommodated in the recesses 21*a* and 21*b*.

The guide rails 2*a*, 2*b*, 3*a*, and 3*b* are fixed to the wall of the hoistway through the rail brackets (not shown). Embodiment 2 is substantially the same as Embodiment 1 in other constructional details. Further, the first and second elevator units 101 and 102 are basically identical in construction.

In the elevator apparatus constructed as described above, since the car guide shoes 20*a* and 20*b* and the car guide rails 2*a* and 2*b* are disposed in the recesses 21*a* and 21*b* provided in the cage 6, the installation space for the elevator apparatus in the width direction of the car 4 can be reduced. As a result, the space for the hoistway can further be reduced.

In particular, in an elevator apparatus having such a construction that the first and second elevator units 101 and 102 are disposed in parallel within the hoistway 1, the clearance between the first and second elevator units 101 and 102 can be set to a minimum required value, so that the space for the hoistway can be effectively reduced.

Further, since the car guide shoes 20*a* and 20*b* and the car guide rails 2*a*, and 2*b* are disposed at diagonal positions of the car 4, the clearance between the car guide rails 2*a* and 2*b* can be widened, so that vibrations around a vertical axis of the traveling car 4 are suppressed. As a result, the car 4 can be stably raised and lowered. Thus, relatively inexpensive sliding guide shoes or the like can be employed as the car guide shoes 20*a* and 20*b*, so that cost reduction is made possible.

In addition, the recesses 21*a* to 21*d* are provided in the respective four corners of the cage 6. Therefore, even when the car 4 and the counterweight 5 pass each other within the narrow hoistway 1, air can be let out through the recesses 21*a* to 21*d*. As a result, the generation of impact noise or vibrations at the time when they pass each other can be suppressed.

Furthermore, since the safety device 22 is at least partially disposed in the recesses 21*a* and 21*b*, it can be prevented from protruding from the car 4. This makes it possible to reduce the installation space for the elevator apparatus in the width direction of the car 4 and further reduce the space for the hoistway.

In this elevator apparatus, since neither the car guide shoes 20*a* and 20*b* nor the car guide rails 2*a* and 2*b* are disposed between the first and second cars 4*a* and 4*b*, the second rope connecting portion 8*b* of the first car 4*a* and the first rope connecting portion 8*a* of the second car 4*b* can be disposed with an overlap amount E in the width direction of the car 4. Thus, the clearance between the first and second cars 4*a* and 4*b* can be made smaller than the double of a protruding amount of the rope connecting portions 8*a* and 8*b* from the side faces 6*c* and 6*d* ($\delta \times 2$ in the figure).

Embodiment 3

Figure 8:
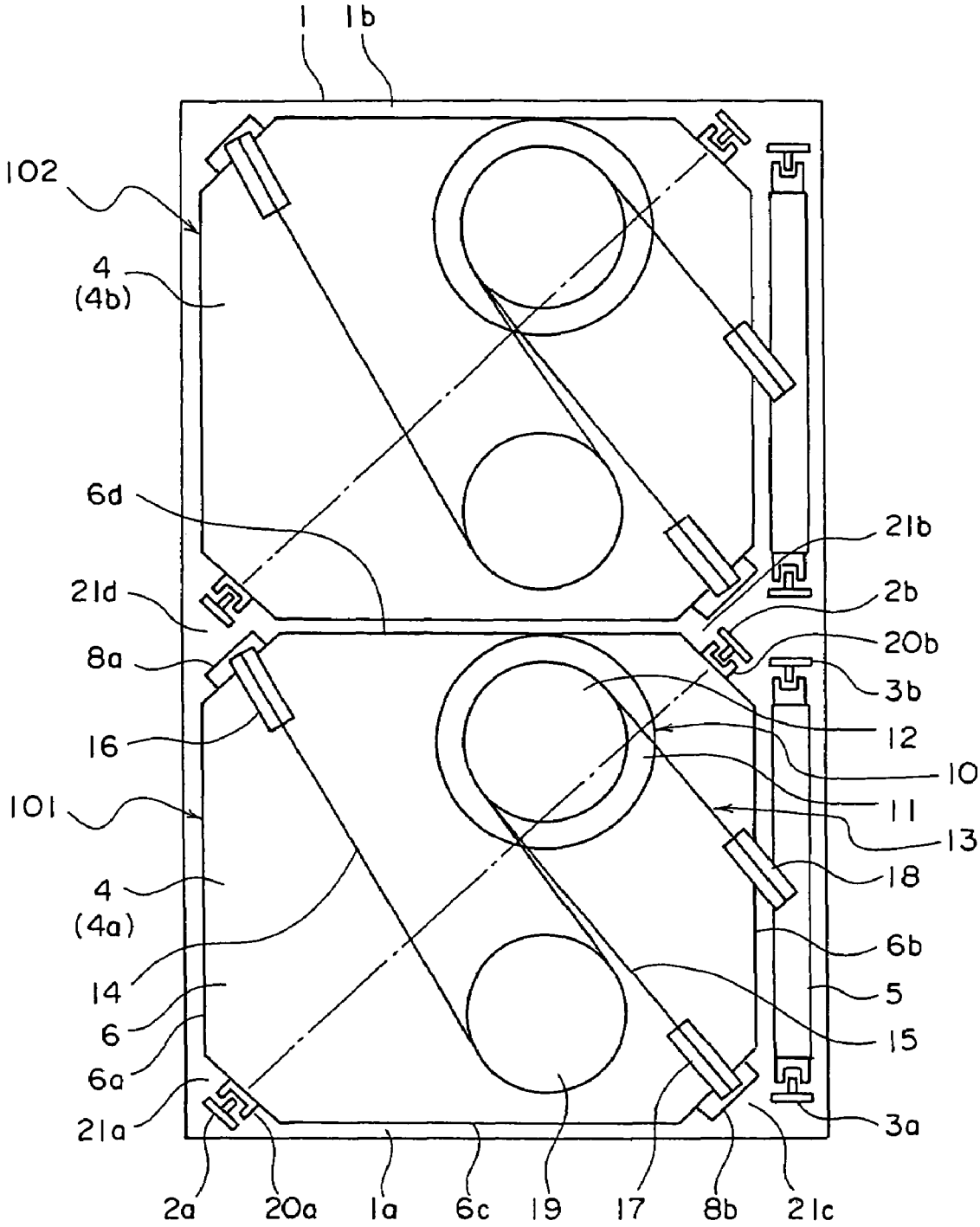
FIG. 8 is a plan view showing an elevator apparatus according to Embodiment 3 of the present invention.

Next, FIG. 8 is a plan view showing an elevator apparatus according to Embodiment 3 of the present invention. Referring to the figure, the first and second rope connecting portions 8*a* and 8*b* are disposed in the fourth and third recesses 21*d* and 21*c* respectively on the vertical projection plane. Accordingly, the first and second pulleys 16 and 17 are disposed above the fourth and third recesses 21*d* and 21*c* respectively. Thus, the layout of the drive device 10 and the deflection pulley 19 is also slightly different from that of Embodiment 2.

On the vertical projection plane, the dimension between the first and second cars 4*a* and 4*b* is smaller than the outer diameter dimension of the car guide rail 2*a* (or 2*b*). In other words, the dimension between the first and second cars 4*a* and 4*b* is small enough to make it impossible to dispose the car guide rail 2*a* (or 2*b*). Embodiment 3 is substantially the same as Embodiment 2 in other constructional details.

In the elevator apparatus constructed as described above, since the rope connecting portions 8*a* and 8*b* are disposed in the recesses 21*d* and 21*c*, the installation space for the elevator apparatus in the width direction of the car 4 can further be reduced. As a result, the space for the hoistway can further be reduced.

Embodiment 4

Figure 9:
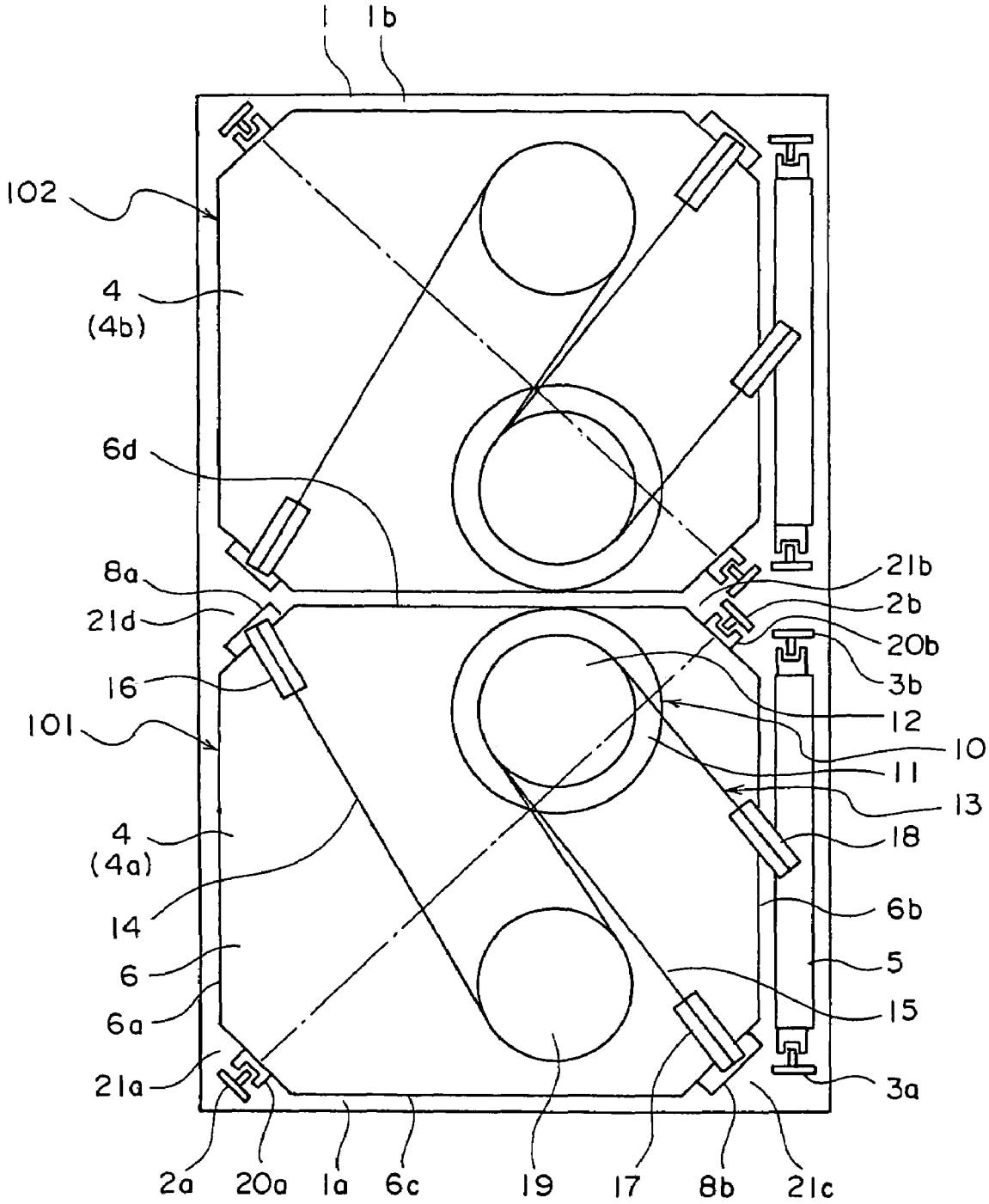
FIG. 9 is a plan view showing an elevator apparatus according to Embodiment 4 of the present invention.

Next, FIG. 9 is a plan view showing an elevator apparatus according to Embodiment 4 of the present invention. In this example, on the vertical projection plane, components of the first and second elevator units 101 and 102 are disposed symmetrically with respect to a boundary line between the first and second elevator units 101 and 102.

Thus, the second recesses 21*b* of the first and second elevator units 101 and 102 are adjacent to each other. The second car guide rail 2*b* and the second counterweight guide rail 3*b* of the first elevator unit 101, and the second car guide rail 2*b* and the first counterweight guide rail 3*a* of the second elevator unit 102 are disposed at one location in a concentrated manner.

Figure 10:
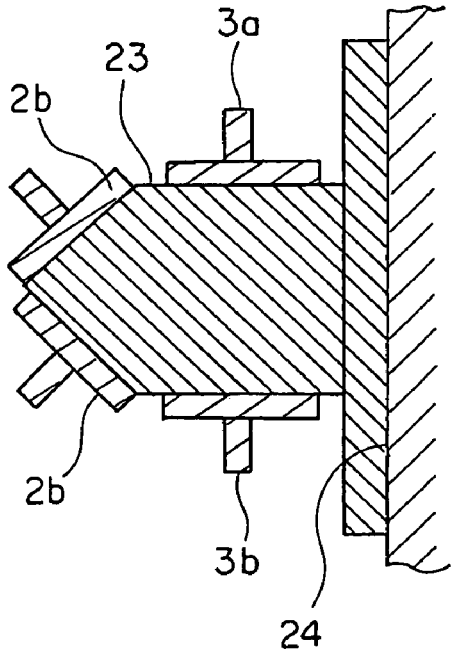
FIG. 10 is a sectional view showing an example of a mounting structure of a second car guide rail of FIG. 9.

FIG. 10 is a cross-sectional view showing an example of a mounting structure of the second car guide rail 2*b* of FIG. 9. Since the guide rails 2*b*, 3*a*, and 3*b* are disposed at one location in a concentrated manner, they can be fixed to a wall 24 of the hoistway by means of a common bracket 23.

Figure 11:
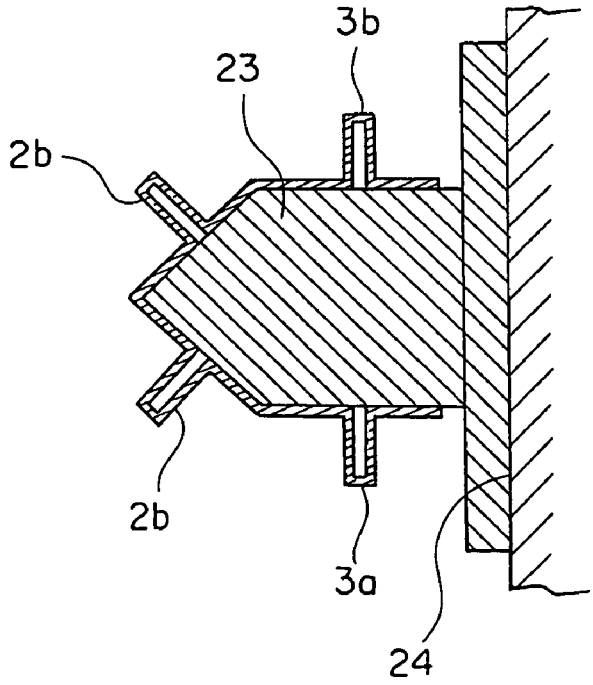
FIG. 11 is a sectional view showing an other example of a mounting structure of the second car guide rail of FIG. 9.

Further, FIG. 11 is a cross-sectional view showing another example of a mounting structure of the second car guide rail of FIG. 9. As shown in FIG. 11, the guide rails 2*b*, 3*a*, and 3*b* can also be constructed as an integral unit.

Also in the elevator apparatus constructed as described above, since the rope connecting portions 8*a* and 8*b* are disposed in the recesses 21*d* and 21*c*, the installation space for the elevator apparatus in the width direction of the car 4 can further be reduced. As a result, the space for the hoistway can further be reduced.

Further, since the four guide rails 2*b*, 3*a*, and 3*b* are disposed at one location in a concentrated manner, the efficiency of installation can be enhanced.

In the elevator apparatuses of Embodiments 3 and 4, entrances may be provided on the first side face 6*c* side of the first car 4*a* and on the second side face 6*d* side of the second car 4*b*.

Further, in the elevator apparatuses of Embodiments 1 to 4, three or more elevator units may be installed in parallel in the width direction of the car 4.

Embodiment 5

Figure 12:
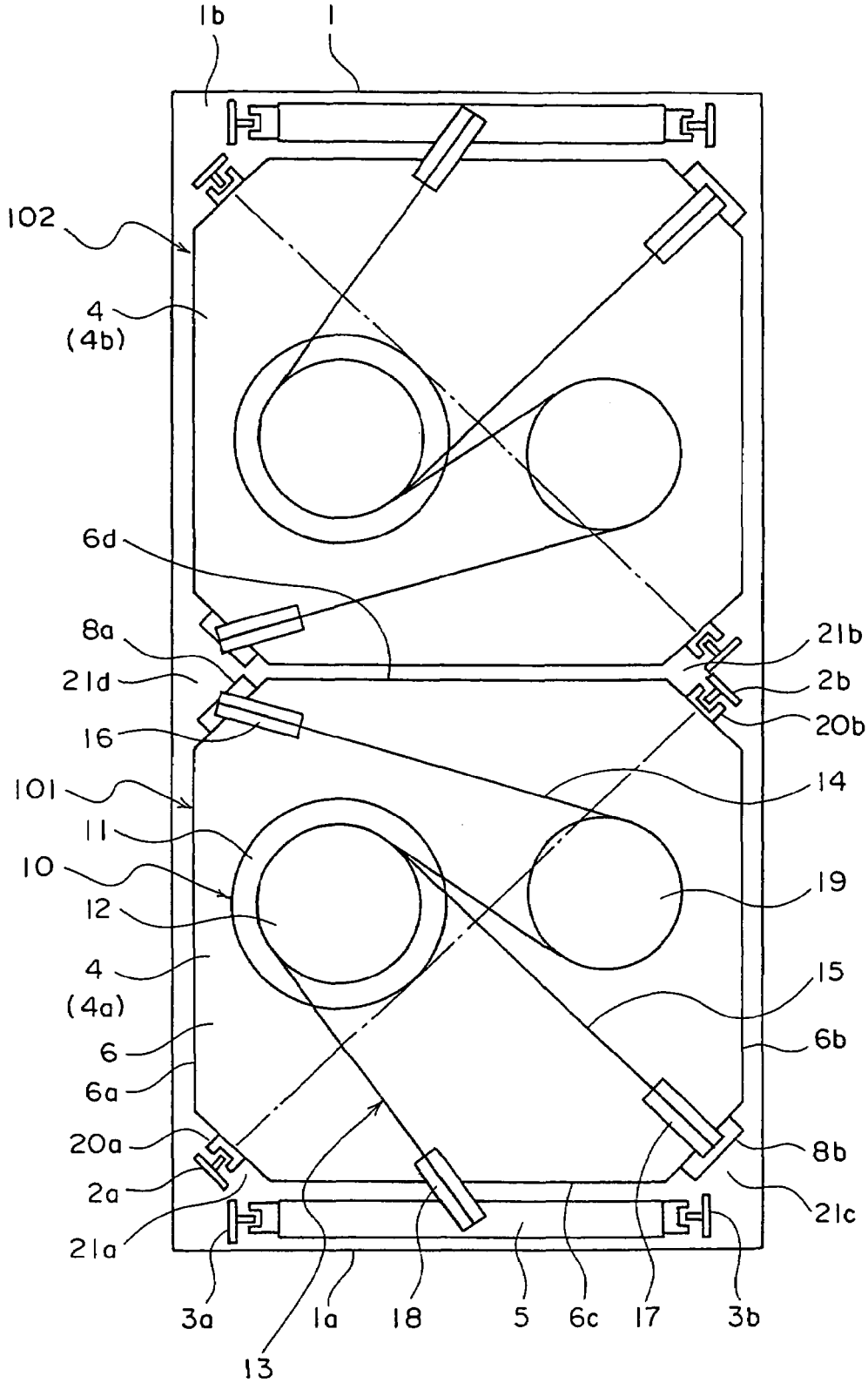
FIG. 12 is a plan view showing an elevator apparatus according to Embodiment 5 of the present invention.

Next, FIG. 12 is a plan view showing an elevator apparatus according to Embodiment 5 of the present invention. Referring to the figure, the counterweight 5 (first counterweight) of the first elevator unit 101 is disposed beside the first car 4*a* so that the counterweight 5 faces the first side face 6*c* of the first car 4*a* when it is located at the same height as the first car 4*a*. Further, the counterweight 5 (second counterweight) of the second elevator unit 102 is disposed beside the second car 4*b* so that the counterweight 5 faces the second side face 6*d* of the second car 4*b* when it is located at the same height as the second car 4*b*.

Further, on the vertical projection plane, the components of the first and second elevator units 101 and 102 are disposed symmetrically with respect to the boundary line between the first and second elevator units 101 and 102.

Also in the elevator apparatus of the layout as described above, since the car guide shoes 20*a* and 20*b* and the car guide rails 2*a* and 2*b* are disposed in the recesses 21*a* and 21*b* provided in the cage 6, the installation space for the elevator apparatus in the width direction of the car 4 can be reduced. As a result, the space for the hoistway can further be reduced.

In particular, in an elevator apparatus having such a construction that the first and second elevator units 101 and 102 are disposed in parallel within the hoistway 1, the clearance between the first and second elevator units 101 and 102 can be set to a minimum required value, so that the space for the hoistway can be effectively reduced.

Further, since the counterweight 5 is disposed beside the car 4, the dimension in the depth direction (the right and left direction of FIG. 12) of the hoistway 1 can be reduced.

Further, since the rope connecting portions 8*a* and 8*b* are disposed in the recesses 21*d* and 21*c*, the installation space for the elevator apparatus in the width direction of the car 4 can further be reduced. As a result, the space for the hoistway can further be reduced.

In the elevator apparatus of Embodiment 5, an entrance may also be provided on the rear face 6*b* side.

Embodiment 6

Figure 13:
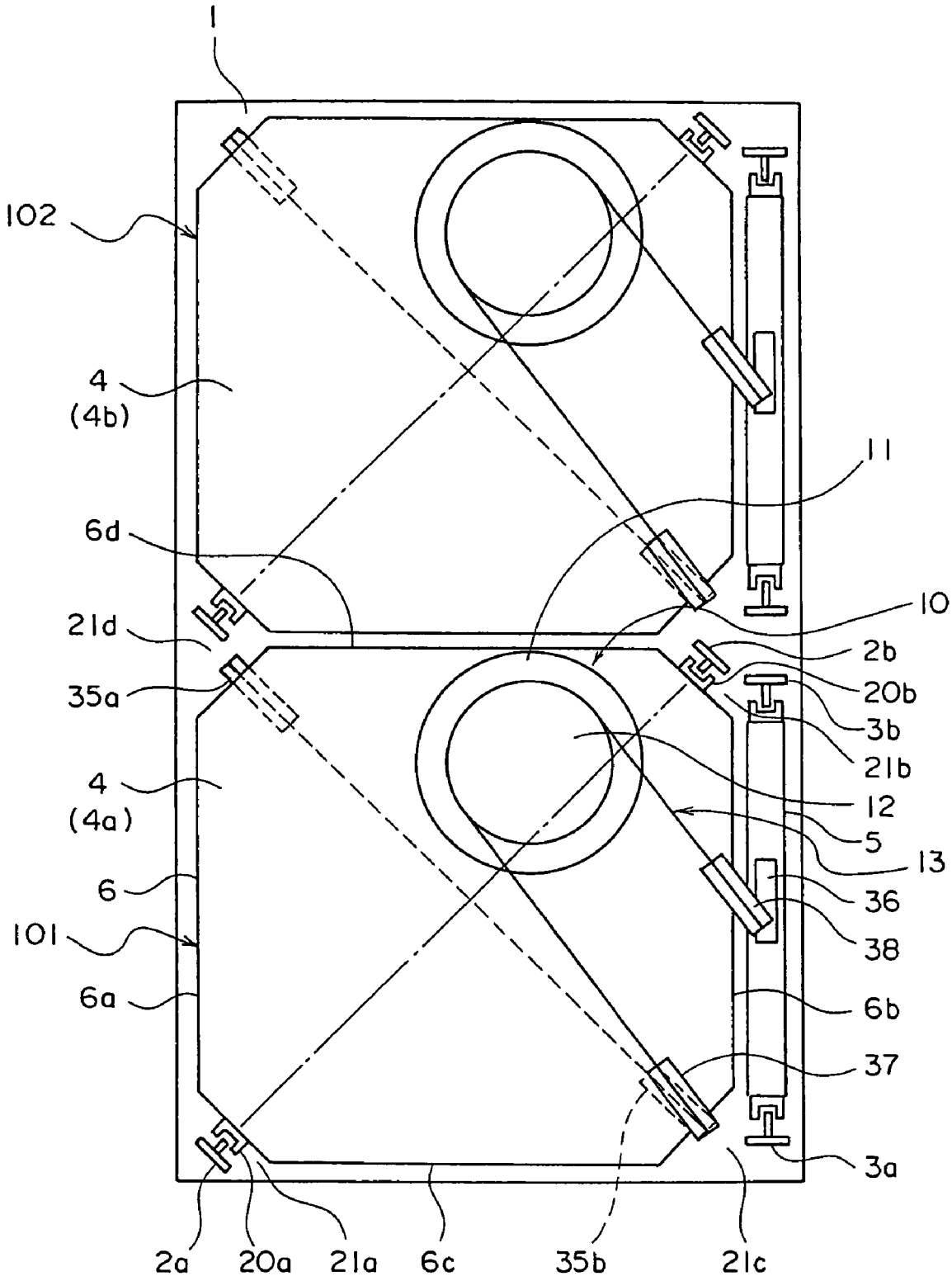
FIG. 13 is a plan view showing an elevator apparatus according to Embodiment 6 of the present invention.
Figure 14:
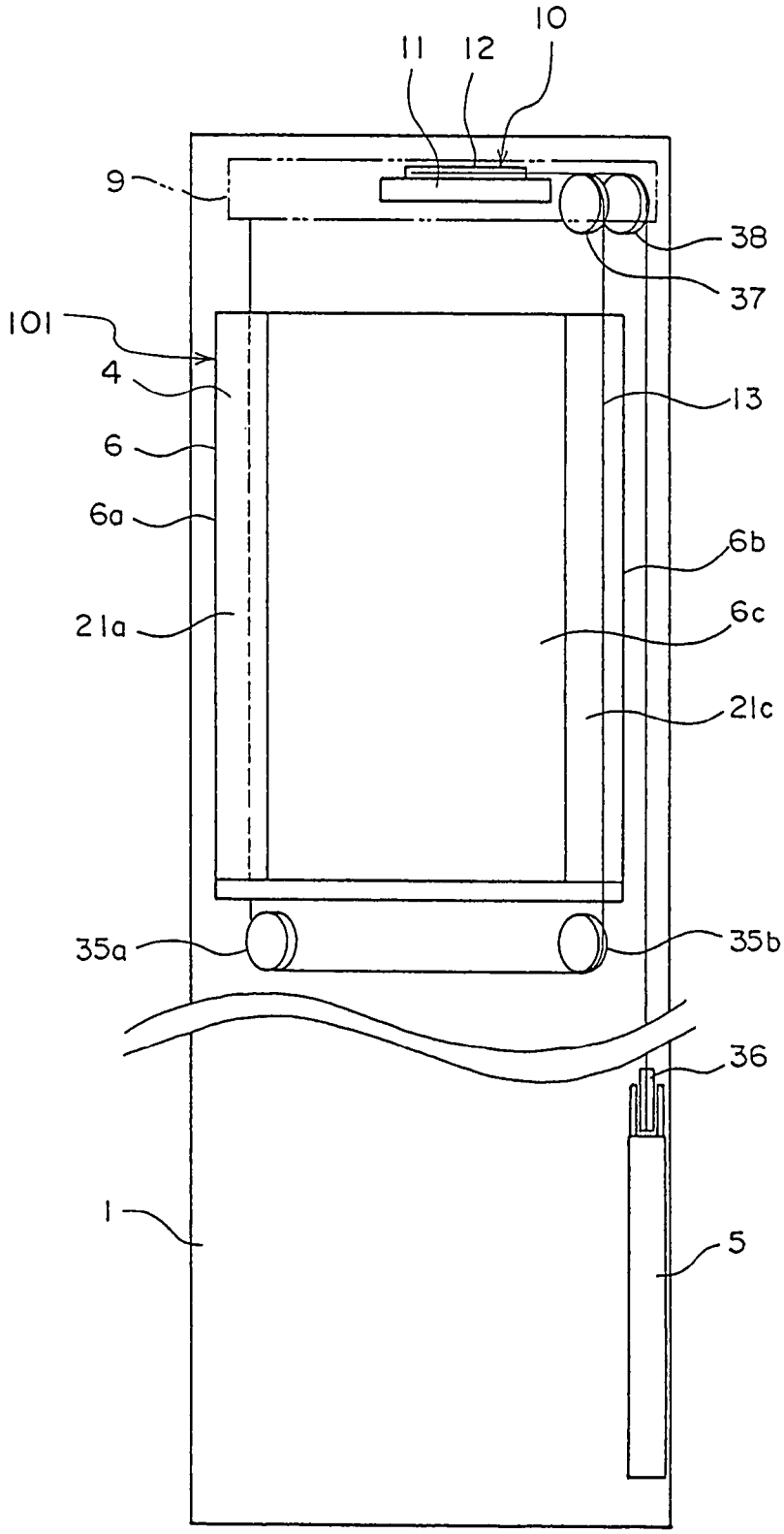
FIG. 14 is a side view showing the elevator apparatus of FIG. 13.

Next, FIG. 13 is a plan view showing an elevator apparatus according to Embodiment 6 of the present invention. FIG. 14 is a side view showing the elevator apparatus of FIG. 13.

Referring to the figures, first and second car suspending pulleys 35*a* and 35*b* are provided in the lower portion of the car 4. The first car suspending pulley 35*a* is so disposed as to be partially located in the fourth recess 21*d* on the vertical projection plane. The second car suspending pulley 35*b* is so disposed as to be partially located in the third recess 21*c* on the vertical projection plane.

A counterweight suspending pulley 36 is provided in the upper portion of the counterweight 5. The main rope group 13 including a plurality of main ropes is wound around the car suspending pulleys 35*a* and 35*b* and the counterweight suspending pulley 36.

A car-side return pulley 37 for guiding the main rope group 13 from the drive sheave 12 to the car suspending pulley 35*b*, and a counterweight-side return pulley 38 for guiding the main rope group 13 from the drive sheave 12 to the counterweight suspending pulley 36 are provided in the upper portion of the hoistway 1. The return pulleys 37 and 38 have horizontal rotating shafts.

A first end portion (car-side end portion) and a second end portion (counterweight-side end portion) of the main rope group 13 are connected to the support frame 9. Further, the main rope group 13 is wound, sequentially from the side of the first end portion, around the car suspending pulleys 35*a* and 35*b*, the car-side return pulley 37, the drive sheave 12, the counterweight-side return pulley 38, and the counterweight suspending pulley 36. That is, in Embodiment 6, the car 4 and the counterweight 5 are suspended within the hoistway 1 according to a 2:1 roping method by means of the main rope group 13.

Further, the main rope group 13 partially extends through the third and fourth recesses 21*c* and 21*d*. Embodiment 6 is substantially the same as Embodiment 3 in other constructional details. Further, the first and second elevator units 101 and 102 are basically identical in construction.

Also in the elevator apparatus employing the 2:1 roping method as described above, since the car guide shoes 20*a* and 20*b* and the car guide rails 2*a* and 2*b* are disposed in the recesses 21*a* and 21*b* provided in the cage 6, the installation space for the elevator apparatus in the width direction of the car 4 can be reduced. As a result, the space for the hoistway can further be reduced.

In particular, in an elevator apparatus having such a construction that the first and second elevator units 101 and 102 are disposed in parallel within the hoistway 1, the clearance between the first and second elevator units 101 and 102 can be set to a minimum required value, so that the space for the hoistway can be effectively reduced.

Further, the car suspending pulleys 35*a* and 35*b* are partially disposed in the recesses 21*d* and 21*c* respectively on the vertical projection plane, and the main rope group 13 extends through the recesses 21*d* and 21*c*. This also makes it possible to reduce the installation space for the elevator apparatus in the width direction of the car 4 and further reduce the space for the hoistway.

In the elevator apparatus of Embodiment 6, entrances may also be provided on the first side face 6*c* side of the first car 4*a* and on the second side face 6*d* side of the second car 4*b*.

Also, the 2:1 roping method may be adopted in the layouts of all the embodiments.

Embodiment 7

Figure 15:
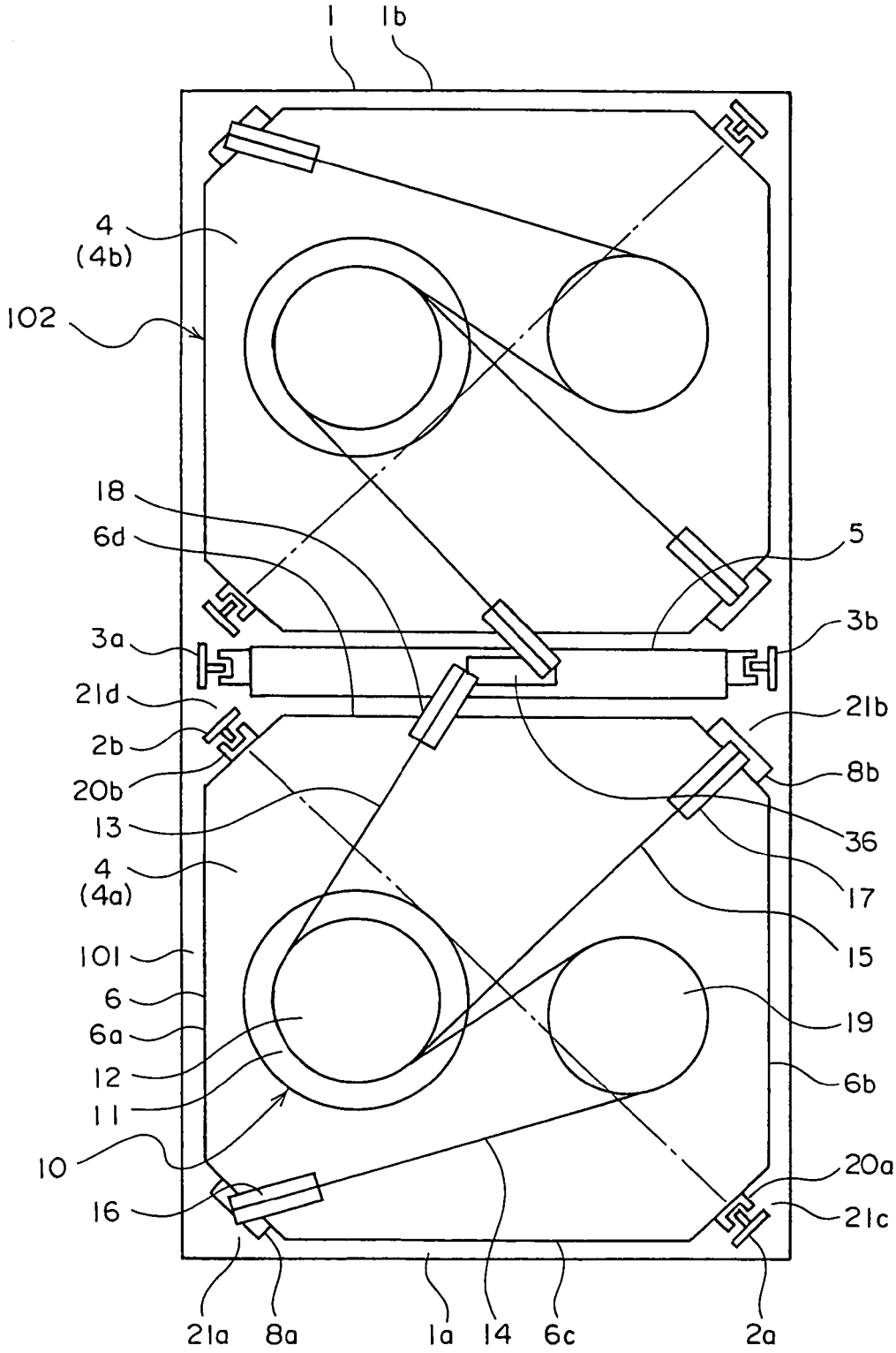
FIG. 15 is a plan view showing an elevator apparatus according to Embodiment 7 of the present invention.

Next, FIG. 15 is a plan view showing an elevator apparatus according to Embodiment 7 of the present invention. Referring to the figure, the first and second rope connecting portions 8*a* and 8*b* are disposed in the first and second recesses 21*a* and 21*b* on the vertical projection plane. Accordingly, the first and second pulleys 16 and 17 are disposed above the first and second recesses 21*a* and 21*b* respectively.

The first car guide shoe 20*a* engaging the first car guide rail 2*a* is at least partially disposed in the third recess 21*c*. The second car guide shoe 20*b* engaging the second car guide rail 2*b* is at least partially disposed in the fourth recess 21*d*.

Further, on the vertical projection plane, the car guide rails 2*a* and 2*b* are at least partially disposed in the recesses 21*c* and 21*d* respectively. The car guide rails 2*a* and 2*b*, which face each other, face the bottom faces of the third and fourth recesses 21*c* and 21*d* respectively.

The counterweight 5, which is disposed between the first and second elevator units 101 and 102, is common to the first and second elevator units 101 and 102. The counterweight suspending pulley 36 is provided in the upper portion of the counterweight 5. The main rope group 13 is wound around the counterweight suspending pulley 36.

The main rope group 13 of the first and second elevator units 101 and 102 extends continuously. That is, the main rope group 13 extending from the drive sheave 12 of the first elevator unit 101 via the third pulley 18 and wound around the counterweight suspending pulley 36 extends via the third pulley 18 of the second elevator unit 102 and is wound around the drive sheave 12 of the second elevator unit 102.

Further, the components of the first and second elevator units 101 and 102 are disposed symmetrically with respect to the boundary between the first and second elevator units on the vertical projection plane.

In the elevator apparatus constructed as described above, the counterweight 5 is common to the first and second elevator units 101 and 102. In comparison with the elevator apparatus of Embodiment 5, therefore, the dimension of the hoistway 1 in the frontage direction of the car 4 can be reduced.

Further, the troublesomeness in installing the counterweight guide rails 3*a* and 3*b* can be alleviated.

Furthermore, since the counterweight 5 is disposed between the first and second elevator units 101 and 102, an elevator hall (entrance) can be provided in any one of the four faces surrounding the hoistway 1. As a result, the degree of freedom in design can be enhanced.

Embodiment 8

Figure 16:
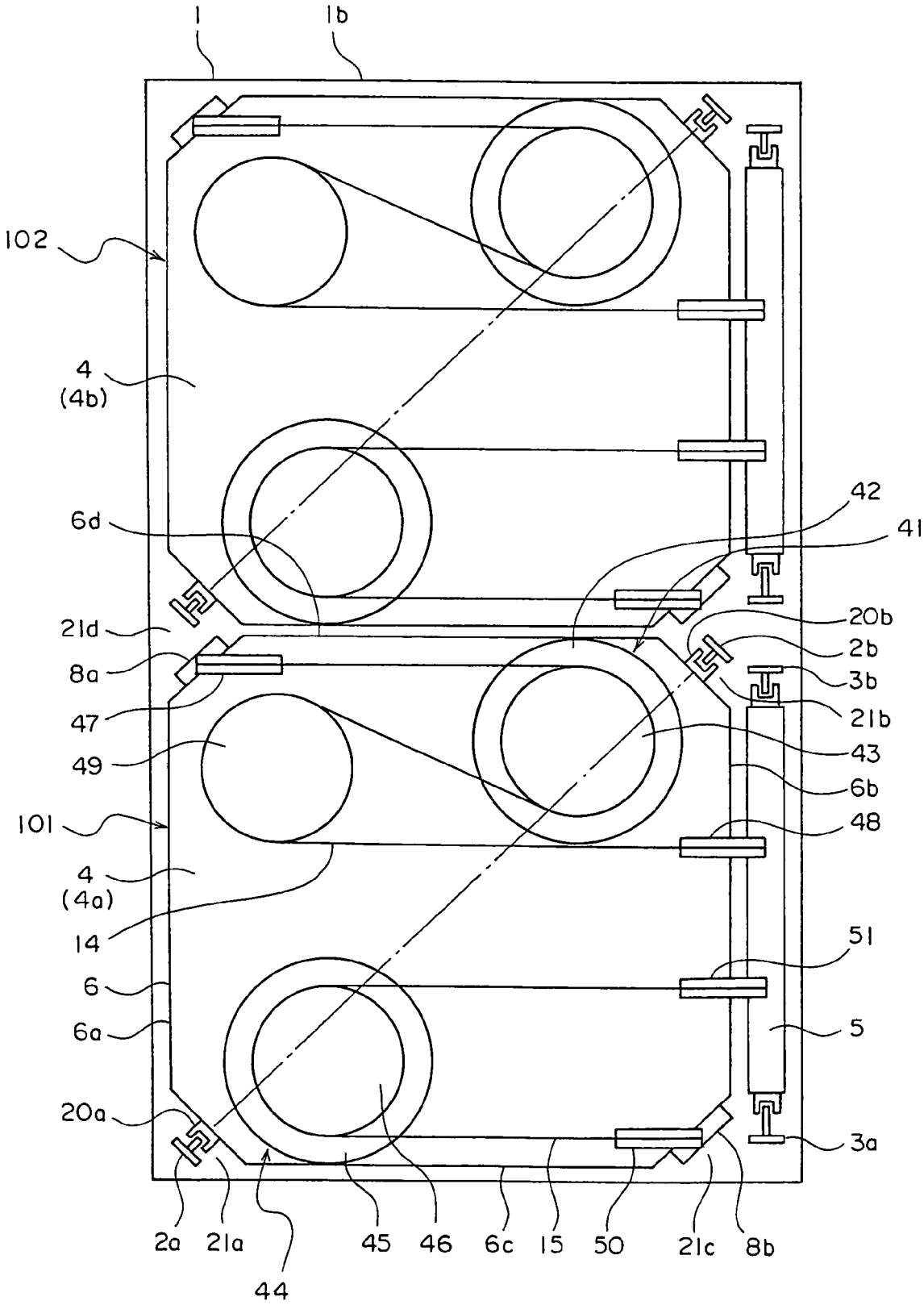
FIG. 16 is a plan view showing an elevator apparatus according to Embodiment 8 of the present invention.

Next, FIG. 16 is a plan view showing an elevator apparatus according to Embodiment 8 of the present invention. Since the first and second elevator units 101 and 102 are basically identical in construction, the construction of the first elevator unit 101 will be mainly described.

First and second drive devices 41 and 44 are provided in an upper portion within the hoistway 1*a* . The first drive device 41 has a first drive device main body 42 including a motor and a brake, and a first drive sheave 43 rotated by the first drive device main body 42. The second drive device 44 has a second drive device main body 45 including a motor and a brake, and a second drive sheave 46 rotated by the second drive device main body 45.

In this example, the drive sheaves 43 and 46 are disposed on the drive device main bodies 42 and 45 respectively. Further, the drive devices 41 and 44 are disposed horizontally (or substantially horizontally) such that rotating shafts of the drive sheaves 43 and 46 extend vertically (or substantially vertically). Furthermore, thin hoisting machines having an axial dimension smaller than a radial dimension of the drive sheaves 43 and 46 or a radial dimension of the drive device main bodies 42 and 45 are employed as the drive devices 41 and 44.

In addition, the drive devices 41 and 44 entirely or substantially entirely overlap each other on the vertical projection plane. That is, the drive devices 41 and 44 are disposed directly above the car 4. More specifically, the drive devices 41 and 44 are disposed at the diagonal positions of the car 4 on the vertical projection plane.

A plurality of first main ropes 14 (only one of which is shown in the figure) for suspending the car 4 and the counterweight 5 within the hoistway 1 are wound around the first drive sheave 43. A plurality of second main ropes 15 (only one of which is shown in the figure) for suspending the car 4 and the counterweight 5 within the hoistway 1 are wound around the second drive sheave 46.

The car 4 and the counterweight 5 are suspended according to the 1:1 roping method by means of the main ropes 14 and 15.

A first car-side return pulley 47 for guiding the first main ropes 14 to the first rope connecting portion 8*a*, a first counterweight-side return pulley 48 for guiding the first main ropes 14 to the counterweight 5, a deflection pulley 49 for guiding the first main ropes 14 from the first drive sheave 43 to the first counterweight-side return pulley 48, a second car-side return pulley 50 for guiding the second main ropes 15 to the second rope connecting portion 8*b*, and a second counterweight-side return pulley 51 for guiding the second main ropes 15 to the counterweight 5 are provided in the upper portion within the hoistway 1*a*.

The first car-side return pulley 47, the first counterweight-side return pulley 48, the second car-side return pulley 50, and the second counterweight-side return pulley 51 are disposed such that their rotating shafts extend horizontally. The deflection pulley 49 is disposed such that its rotating shaft extends vertically or substantially vertically.

The portions of the first main ropes 14 between the first drive sheave 43 and the first car-side return pulley 47, the portions of the first main ropes 14 between the deflection pulley 49 and the first counterweight-side return pulley 48, the portions of the second main ropes 15 between the second drive sheave 46 and the second car-side return pulley 50, and the portions of the second main ropes 15 between the second drive sheave 46 and the second counterweight-side return pulley 51 are parallel to one another and parallel to the depth direction of the car 4.

A second end portion (counterweight-side end portion) of each first main rope 14 and a fourth end portion (counterweight-side end portion) of each second main rope 15 are spaced apart from each other in the width direction of the counterweight 5 and connected to the upper portion of the counterweight 5.

In the elevator apparatus constructed as described above, since the car 4 and the counterweight 5 are raised and lowered by driving forces of the first and second drive devices 41 and 43, a large passenger capacity can be ensured.

As described above, even in the case where the two drive devices 41 and 43 are employed, the car guide shoes 20*a* and 20*b* and the car guide rails 2*a* and 2*b* are disposed in the recesses 21*a* and 21*b* provided in the cage 6. Thus, the installation space for the elevator apparatus in the width direction of the car 4 can be reduced. As a result, the space for the hoistway can further be reduced.

In particular, in an elevator apparatus having such a construction that the first and second elevator units 101 and 102 are disposed in parallel within the hoistway 1, the clearance between the first and second elevator units 101 and 102 can be set to a minimum required value, so that the space for the hoistway can be effectively reduced.

Further, since the rope connecting portions 8*a* and 8*b* are disposed in the recesses 21*d* and 21*c*, the installation space for the elevator apparatus in the width direction of the car 4 can further be reduced. As a result, the space for the hoistway can further be reduced.

Embodiment 9

Figure 17:
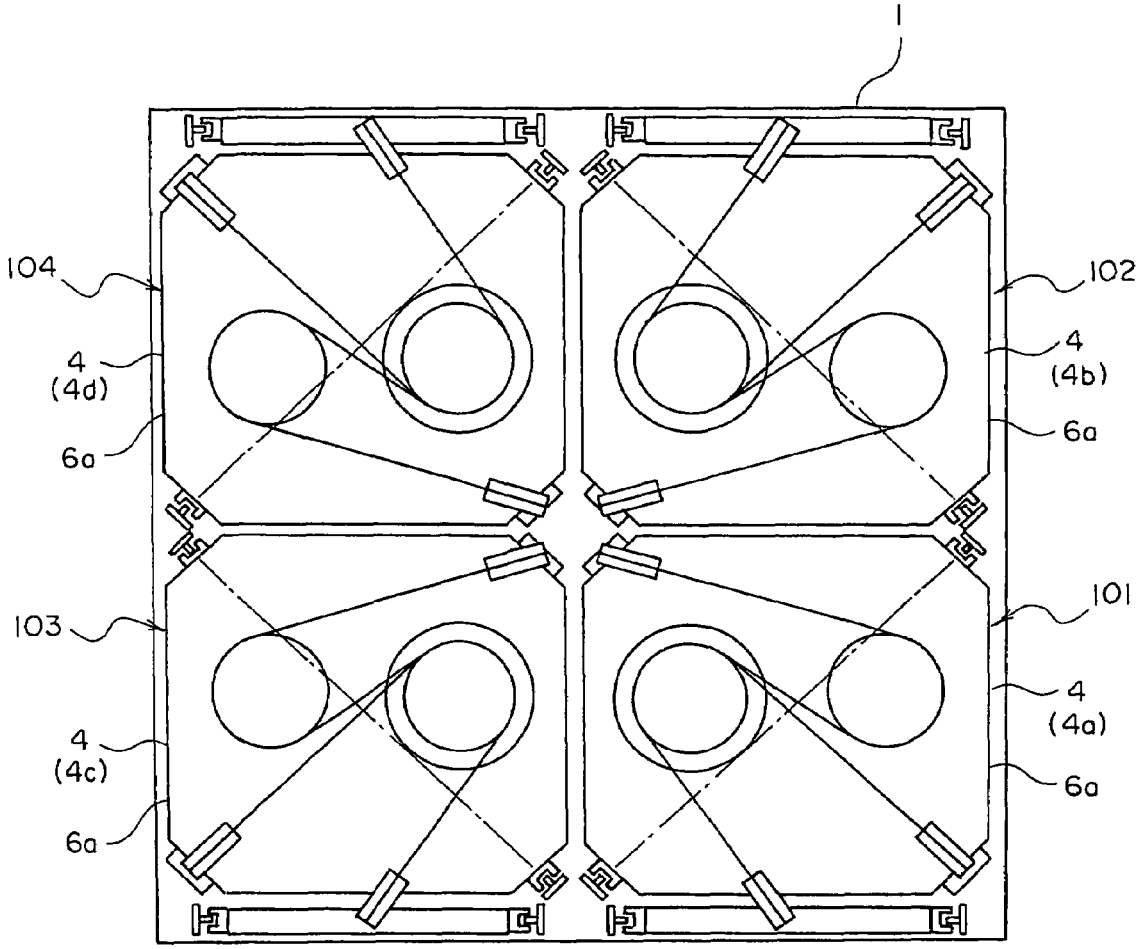
FIG. 17 is a plan view showing an elevator apparatus according to Embodiment 9 of the present invention.

Next, FIG. 17 is a plan view showing an elevator apparatus according to Embodiment 9 of the present invention. In this example, two sets of the first and second elevator units 101 and 102 shown in Embodiment 5 (FIG. 12) are provided. In other words, first to fourth elevator units 101 to 104 are provided within the hoistway 1. Front faces 6*a* of first to fourth cars 4*a* to 4*d* are located on sides facing the walls of the hoistway on the vertical projection plane.

The respective elevator units 101 to 104 are identical in construction to those of Embodiment 5 and thus will not be described below.

In this manner, the elevator units can also be disposed side by side in the depth direction of the car 4, and the car guide shoes 20*a* and 20*b* and the car guide rails 2*a* and 2*b* are disposed in the recesses 21*a* and 21*b* provided in the cage 6. As a result, the space for the hoistway can be reduced.

In Embodiment 9, the elevator units according to the layout shown in Embodiment 5 are disposed side by side in the depth direction of the car. Instead, however, the elevator units according to the layouts shown in Embodiments 1 to 4 and Embodiments 6 to 8 may be disposed side by side in the depth direction of the car.

Further, in the elevator apparatus shown in Embodiment 9, three or more elevator units may be installed in parallel in the width direction of the car 4.

In the aforementioned examples, the elevator apparatus of the 1:1 roping method and the elevator apparatus of the 2:1 roping method are illustrated. However, the roping method is not limited to these.

Further, in the aforementioned examples, the machine-room-less elevator having the drive device disposed in the hoistway is illustrated. However, the present invention is also applicable to an elevator apparatus having a machine room in which a drive device and a control panel are installed.

Furthermore, the present invention makes it possible to reduce the space for the hoistway and is therefore particularly advantageous when applied to an elevator apparatus having a structure in which neither a drive device nor a control panel is disposed between a car and a wall of a hoistway.

Still further, in the aforementioned examples, the drive device is disposed such that the rotating shaft of the drive sheave extends vertically or substantially vertically. However, the manner of disposition of the drive device is not limited to this. For instance, the drive device may be disposed such that the rotating shaft of the drive sheave extends horizontally.

Further, in the aforementioned examples, the drive device is disposed such that the drive sheave is located in the upper portion of the drive device main body. Conversely, however, the drive device may also be disposed such that the drive sheave is located in the lower portion of the drive device main body.

Furthermore, in the aforementioned examples, the drive device is disposed in the upper portion of the hoistway. However, the position of the drive device is not limited to this. For instance, the drive device may also be disposed in the lower portion within the hoistway. Further, the present invention is also applicable to a self-propelled elevator apparatus having a drive device mounted in an upper or lower portion of a car.

Still further, for example, ropes having a circular cross-section, belt-type ropes, or the like can be employed as the main ropes.

Further, for example, steel ropes, resin-coated ropes having an outer layer coating member made of a high-friction resin material provided on an outer periphery portion, or the like can be employed as the main ropes. The use of resin-coated ropes makes it possible to ensure a large traction force at a small contact angle. Further, the resin-coated ropes can enhance flexibility more than simple steel ropes and thus reduce the requisite diameter of the drive sheave.

In addition, the components (drive device, return pulley, deflection pulley, and the like) disposed in the upper portion within the hoistway 1 may be unitized by being mounted on a common support frame.

Still further, in the aforementioned examples, all the car guide shoes are disposed in the recesses. However, only the car guide shoes on one side may be disposed in the recesses.

The invention claimed is:

1. An elevator apparatus comprising:

a plurality of cars located within a hoistway so that the plurality of cars are adjacent to one another when located at equal height, the plurality of cars each being raised and lowered within the hoistway;

a plurality of car guide rails disposed within the hoistway, for guiding the cars when the cars are raised and lowered; and a plurality of car guide shoes mounted on the respective cars, for engaging the car guide rails, wherein, at least one of the cars is defined as a first car and a car adjacent to the first car is defined as a second car, each of the first and second cars has a first pair of chamfered sides perpendicular to a diagonal line in a horizontal plane and passing through the respective car, the first car includes a second pair of the chamfered sides, each of the first and second pairs of chamfered sides being perpendicular to a respective one of two intersecting diagonals of the first car in the horizontal plane and passing through the first car;

the car guide shoes and the car guide rails are disposed at the diagonally opposite first pair of the chamfered sides; and rope connecting portions to which main ropes for suspending the first car are connected are disposed at the diagonally opposite second pair of the chamfered sides.

2. The elevator apparatus according to claim 1, wherein the car guide shoes of a respective car are disposed substantially inside a region surrounded by a straight line extending along at least one of a front face and a rear face of the car, and a straight line extending along a side face of the car, when projected onto the horizontal plane.

3. The elevator apparatus according to claim 1, comprising a first elevator unit including the first car and a second elevator unit including the second car, wherein the first elevator unit and the second elevator unit have their respective components disposed symmetrically about an axis when projected onto the horizontal plane.

4. The elevator apparatus according to claim 1, wherein the first pair of the chamfered sides extends continuously along a direction in which the car is raised and lowered.

5. The elevator apparatus according to claim 1, wherein, in cross-section, at least 80% of each of the car guide shoes is accommodated in a respective chamfered side.

6. The elevator apparatus according to claim 1, including:

a counterweight disposed between the first car and the second car when projected onto the horizontal plane;

a counterweight suspending pulley; and a main rope for suspending the first car and a main rope for suspending the second car, connected to each other and wound around the counterweight suspending pulley to suspend the counterweight.

7. The elevator apparatus according to claim 1, comprising:

a first counterweight located within the hoistway so that the first counterweight is adjacent a rear face of the first car when the first car and the first counterweight are at equal height, the first counterweight being raised and lowered within the hoistway, and a second counterweight located within the hoistway so that the second counterweight is adjacent a rear face of the second car when the second car and the second counterweight are at equal height, the second counterweight being raised and lowered within the hoistway.

8. An elevator apparatus comprising:

a plurality of cars located within a hoistway so that the plurality of cars are adjacent to one another when located at equal height, the plurality of cars each being raised and lowered within the hoistway;

a plurality of car guide rails disposed within the hoistway, for guiding the cars when the cars are raised and lowered; and a plurality of car guide shoes mounted on the respective cars, for engaging the car guide rails, wherein, at least one of the cars is defined as a first car and a car adjacent to the first car is defined as a second car, each of the first and second cars has a first pair of chamfered sides perpendicular to a diagonal line in a horizontal plane and passing through the respective car, the first car includes, in a lower portion, a first car suspending pulley and a second car suspending pulley;

a main rope for suspending the first car is wound around the first car suspending pulley and the second car suspending pulley;

the first car includes a second pair of the chamfered sides, each of the first and second pairs of chamfered sides being perpendicular to a respective one of two intersecting diagonals of the first car in the horizontal plane and passing through the first car;

the car guide shoes and the car guide rails are disposed at the diagonally opposite first pair of the chamfered sides; and the first car suspending pulley and the second car suspending pulley are partially disposed at the diagonally opposite second pair of the chamfered sides.

* * * * *